United States Patent [19]

Roncato

[11] 4,411,180

[45] Oct. 25, 1983

[54] PROCESS AND DEVICE FOR INTRODUCTION OF A CONTINUOUS YARN IN A CUTTING MACHINE

[75] Inventor: Giordano Roncato, Aix les Bains, France

[73] Assignee: Vetrotex Saint-Gobain, France

[21] Appl. No.: 299,930

[22] Filed: Sep. 8, 1981

[30] Foreign Application Priority Data

Sep. 12, 1980 [FR] France ..... 80 19704

[51] Int. Cl.[3] ..... D01G 1/04

[52] U.S. Cl. ..... 83/37; 83/347; 83/401; 83/418; 83/913; 65/10.2

[58] Field of Search ..... 83/37, 913, 346, 347, 83/98, 99, 418, 401, 106, 304–306, 60, 61, 63; 65/10.2, 2

[56] References Cited

U.S. PATENT DOCUMENTS

| | | | |
|---|---|---|---|
| 3,285,721 | 11/1966 | Ewing . | |
| 3,557,648 | 1/1971 | Coffin et al. . | |
| 3,731,575 | 5/1973 | Gelin . | |
| 3,815,461 | 6/1974 | Genson . | |
| 4,344,786 | 8/1982 | Symborski | 83/913 X |

FOREIGN PATENT DOCUMENTS

| | | |
|---|---|---|
| 2030230 | of 0000 | France . |
| 2162068 | of 0000 | France . |
| 2204175 | of 0000 | France . |
| 2397370 | of 0000 | France . |
| 960955 | of 0000 | United Kingdom . |
| 1368976 | 11/1972 | United Kingdom . |
| 2000760A | 7/1978 | United Kingdom . |

*Primary Examiner*—Robert E. Garrett
*Assistant Examiner*—L. Meier
*Attorney, Agent, or Firm*—Pennie & Edmonds

[57] ABSTRACT

An apparatus and process is described for deflecting a continuous yarn moving along a first to a second path to lay flat on a surface of an upstream roll of a pair of rolls at least adjacent a cutting zone defined by the circumferential contacting surfaces of the rolls of a cutting machine. The first path of movement is above and in a zone between the sides of one roll, the blade-carrying roll, which may comprise either the upstream or downstream roll, and the yarn is deflected at such time that it is being drawn at an operational speed of movement and at a speed equalized with the drawing speed of movement of other yarns.

20 Claims, 5 Drawing Figures

PROCESS AND DEVICE FOR INTRODUCTION OF A CONTINUOUS YARN IN A CUTTING MACHINE

DESCRIPTION

Technical Field

The present invention relates to apparatus for introducing a continuous length of yarn into the cutting zone of a cutting apparatus by deflecting the yarn from a first path of movement above a cutting zone to a second path of movement at such time as the yarn is moving at a desired speed.

Background Art

The prior art includes apparatus for cutting a continuous length of yarn into individual segments. Typical examples of the prior art include the apparatus disclosed in French Pat. Nos. 2,162,068 to Fibreglass Limited, 2,204,715 to Johns-Manville Corporation and 2,397,370 to Nitto Boseki Co., Ltd.

Briefly, the first of the prior art describes a cutting machine having a pair of rolls comprising a support roll and a blade-carrying roll. The support roll includes a tapered conical extension having a truncated end. The cutting machine is enclosed in a housing providing an opening through which the extension partially projects. A plate having rounded edges toward the housing and spaced from the housing extends over the truncated surface. In a restarting operation, the yarn is manually located to the space and to the tapered conical surface of the extension. The yarn then both winds on and moves along the surface to a position at which it enters between the support roll and blade-carrying roll. At each restart, it is necessary to cause the yarn to move at a linear speed of about 1 to 2 m/sec.

The apparatus described in the Johns-Manville patent is a variant of the previous apparatus. In this connection, one form of the cutting apparatus includes a support roll, likewise including a truncated, conical extension, and a blade-carrying roll. The apparatus, further includes a starting roller made up of a series of disks which are supported in a manner that they are disposed on the surface of the extension. According to the disclosure the support and blade-carrying rolls turn constantly at a normal operating speed. And, during a restart operation the yarn is brought to the apex of the extension on which it winds at a low speed. Because the yarn tends to follow a straight path it wedges between the starting roller and the surface of the extension. The yarn, however, progressively tracks along the extension at an incremently increasing drawing speed and, finally, enters the cutting zone between the support roll and blade-carrying roll.

Finally, the apparatus described in the Nitto Boseki patent is one that comprises a support roll, an auxiliary support roll both coaxial of and adjacent one end of the support roll, and an auxiliary blade-carrying roll arranged to cooperate with the auxiliary support roll. The apparatus provides for the introduction of yarn into the cutting zone from the side and the yarn may be introduced at restart while the rolls of the cutting machine rotate. Particularly, at restart, yarn, held in position by a grooved pulley, may be introduced between the cooperating auxiliary blade-carrying and auxiliary support rolls which travel at slow speed. The speed of these rolls, then, is progressively increased until the yarn reaches its normal drawing speed. At this time, and through movement of the grooved pulley, the yarn is brought into the main cutting zone.

The prior art apparatus are not free of problems and disadvantages. Thus, the apparatus of the Fibreglass Limited patent requires that yarn, at restart, move at a speed of about 1 to 2 m/sec. If the cutting machine is required to handle only a single yarn from a single spinneret, the particular process requirement of speed of movement is not a problem. However, the particular process requirement is likely to be unacceptable under circumstances when a simultaneous cutting of several yarns, coming from several spinnerets is being carried out. To this end, if one yarn breaks for any reason, the drawing of yarn from all spinnerets necessarily must cease. This obviously disturbs the running operation and reduces productivity of the installation, and the stopping and restarting of equipment accelerates wear of parts.

While the Johns-Manville apparatus makes possible the introduction of yarn without any required modification in the rotational speed of movement of the rolls of the cutting machine, the apparatus has been found to suffer from various problems. Actually, to avoid premature breaking of the yarn as the drawing speed is increased it is necessary to significantly extend the truncated conical surface. Further, the cantilevered support roll is subject to pressure exerted by the starting roller on the conical surface with the result that parts quickly wear under circumstances of attainment of drawing speeds of between 30 and 50 m/sec.

The Nitto Boseki apparatus seeks to provide a solution to those problems and disadvantages which result from apparatus designed for the introduction of yarn to a cutting machine whose rolls are moving at high speed. However, the apparatus suffers from drawbacks in maintaining continuous production. To this end, when it is necessary to change the main rolls of the cutting machine it is also necessary to take down and reassemble the auxiliary rolls.

SUMMARY OF THE INVENTION

The apparatus of the present invention for introducing a continuous yarn to a cutting machine seeks to overcome the problems, disadvantages and drawbacks of the prior art. In practice, the process according to the invention is one in which yarn is drawn along a first path in a zone between the sides of a blade-carrying roll of a cutting machine and deflected to a second path toward a cutting zone defined by the zone of contact between the blade-carrying roll and a support roll, both of which rolls are mounted along axes disposed in substantially a horizontal plane. The process and apparatus, more particularly, relates to an apparatus comprising a separate subassembly for deflecting the yarn from the first to the second path to lay the yarn flat at least over a portion of the surface of the upstream roll (as determined by the direction of movement of the yarn) adjacent the entry to the cutting zone.

In one form of the invention, the deflecting apparatus may deflect the yarn to lay flat over a portion of the surface of the blade-carrying roll and in another form, the deflecting apparatus may deflect the yarn to lay flat over a portion of the surface of the support roll. The process and apparatus of the invention also relates to the drive of the deflecting apparatus and the means to cooperate with the continuous yarn to deflect the yarn, as discussed, when the yarn has a speed of movement equal to an operational speed and equalized with the speed of movement of other yarns.

Other features and advantages of the present invention will become clear as the description to be read in conjunction with the drawing continues.

BEST MODE FOR CARRYING OUT THE INVENTION

Figure 2:
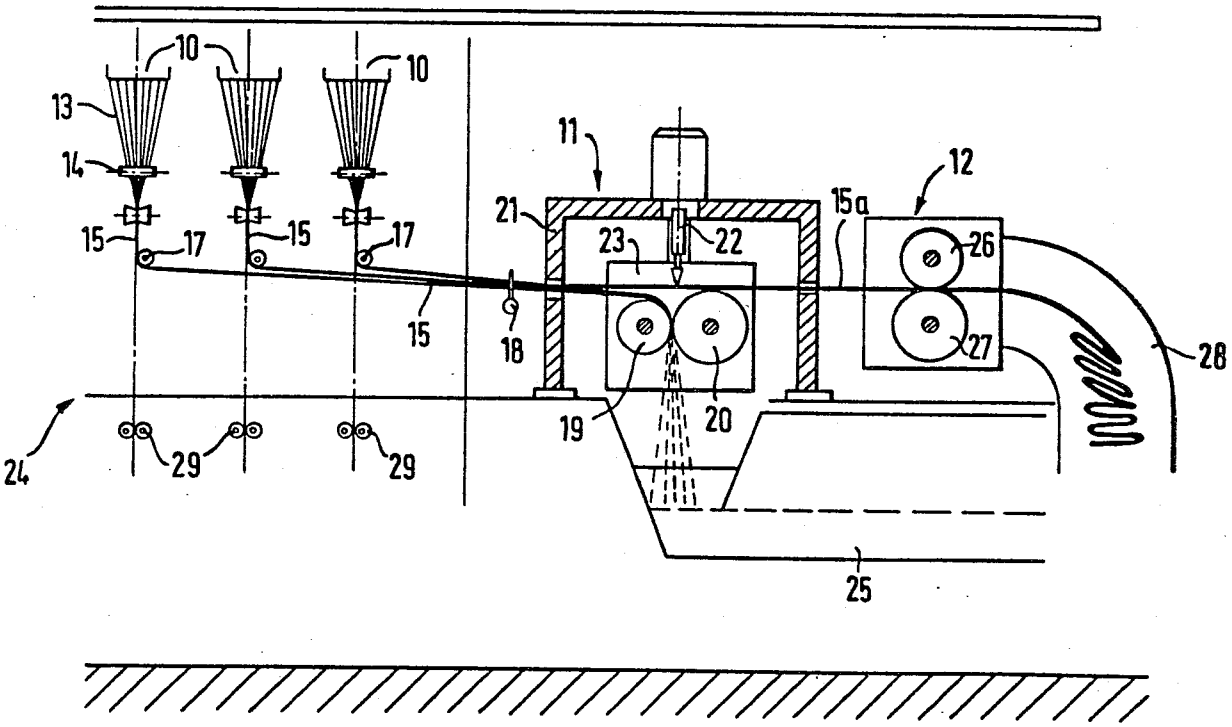
FIG. 2 is a diagrammatic view in side elevation of an installation including a cutting machine for implementing the process of FIG. 1A.

Referring, first, to FIG. 2, it will be seen that the installation includes at least one but preferably a plurality of apparatus, each capable of forming glass or thermoplastic fibers or filaments and, then, functioning in the stranding of filaments into a yarn. Particularly, the apparatus are defined as spinnerets 10. The spinnerets are individually fed (the feeding devices which are not shown may be considered conventional) with the base material from which the filaments, continuously extruded from filament forming dies or bushings (also not shown) are formed.

The embodiments of the present invention to be described herein relate to the production of continuous glass yarn (hereafter "yarn") and particularly to the apparatus for deflecting the yarn from a path along which it is first drawn to a second path, and introducing the deflected yarn into a cutting zone of the cutting machine. In operation, molten glass or glass in the form of glass balls is fed to the spinnerets and filaments 13 are mechanically drawn from the filament forming dies or bushings located in the region of the base of each spinneret. The spinnerets may be formed of platinum, alloyed with rhodium, and heated to required temperature by the Joule-Thomson effect.

Filaments 13 are in the form of layers, thereafter coated or sized with a lubricating gumming product, called oiling. Sizing is carried out in an applicator 14 through which the drawn filaments move. A pair of assembly rollers 16 adjacent each applicator function to gather the filaments extruded from each spinneret and treated, as set out above, thereby to form a continuous yarn 15. In the installation of FIG. 2, while three continuous yarns are formed, a fewer or greater number of yarns could be formed equally as well. Since the process including the manipulative steps of drawing the yarns toward the cutting machine along a first path, increasing the linear speed of movement of each yarn to an operational speed thereby to equalize it with the speed of movement of other yarns, deflecting each yarn to a path adjacent the cutting zone of the cutting machine when travelling at the operational speed, causing each yarn to enter the cutting zone and cutting the yarns into a multiplicity of segments is the same for each yarn the following description will be directed to the carrying out of these steps with a single yarn as representative of all yarns.

During an initial period of operation of the installation the yarn is drawn through the nip of the rolls of drawing device 29 located below the spinneret so that the yarn follows the path of movement illustrated by the broken line in FIG. 2. This movement of yarn is continued until such time as the spinneret attains a thermally stable condition. At this stage of the operation, the yarn is trained by manual relocation about the wheel of pulley 17 and moved into drawing device 12, located downstream of unit 11 housing the cutting machine. More particularly, the yarn is moved or introduced into the nip of rollers 26, 27 of the drawing device turning at a slow speed whereby the yarn assumes a linear speed of movement of about 1 m/sec. The speed of movement of the rolls is increased progressively to increase the drawing speed of the yarn to equalize it with the drawing speed of other yarns. During this period of operation the yarn which will pass through drawing device 12 is recovered in a chute 28.

The drawing device may be of the type described in U.S. Pat. No. 3,285,721 to W. H. Ewing, or drawing may be carried out by the cutting machine, or by any known apparatus capable of drawing yarn up to speeds that reach about 50 m/sec.

Figure 1A:
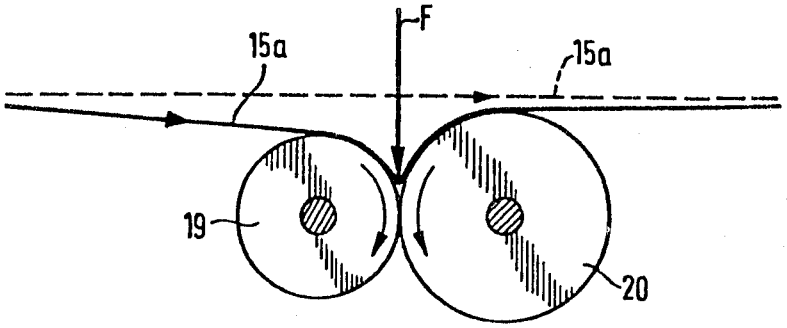
FIGS. 1A and 1B depict schematically alternative processes in the deflection of a continuous length of yarn into the cutting zone of a cutting machine.

Referring to FIG. 1A, the yarn is represented by the numeral "15*a*", and it is illustrated that the yarn has a plurality of paths of movement through the unit 11 relative to the cutting machine. More particularly, the Figure illustrates the yarn as following either of two paths, one of which is represented by a dash line, while the other is represented by a solid line. Until such time that the linear speed of movement of the yarn 15*a* is equalized with the drawing speed of other yarns, yarn 15*a* moves along the dash line path. This path of movement is free of any contact with roll 19, and roll 20 which together generally comprise the cutting machine. When the linear speed of movement of yarn 15*a* equalizes with other yarns, the yarns are deflected by structure to be described. The structure is represented by the force arrow F in FIG. 1A. Upon deflection of the yarn, it will first follow the full line path at which it remains until ultimately it is carried into the cutting zone of the cutting machine thereby to be cut to individual segments. FIG. 1A illustrates that the yarn is laid flat along surface portions of both the rolls 19 and 20 in the full line path of travel, which positions are closely adjacent the cutting zone.

The drawing device 12, in addition to drawing the yarns, functions with the several pulleys 17 both to maintain the path of travel of the yarns along the dash line path until the drawing speeds are equalized and to locate the yarns generally to a zone above roll 19 and between the planes including the sidewalls of the roll. A guide 18 in the form of a comb provides additional localization and maintains a slight degree of separation between individual yarns.

With reference, again, to FIG. 2, until 11 includes a frame 21 supported on any support structure, such as floor 24. Each of rolls 19, 20 are supported by the frame (the support structure which is conventional is not shown) in a disposition that the axes of the rolls pass through substantially a horizontal plane. Thus, the nip of the rolls, that is the cutting zone, will be substantially vertical and cut segments of yarns will generally be discharged downwardly to be received by a transfer device 25, such as a web of a conveyor located below the cutting machine. An elongated channel formed in the floor, having a length at least equal to the length of roll 19 comprising the blade-carrying roll, provides communication between the cutting machine and conveyor. Deflecting apparatus 22, diagrammatically illustrated in FIG. 2, and a hood 23 which surrounds the deflecting apparatus are also supported by the frame (the support structure is not shown).

Figure 3:
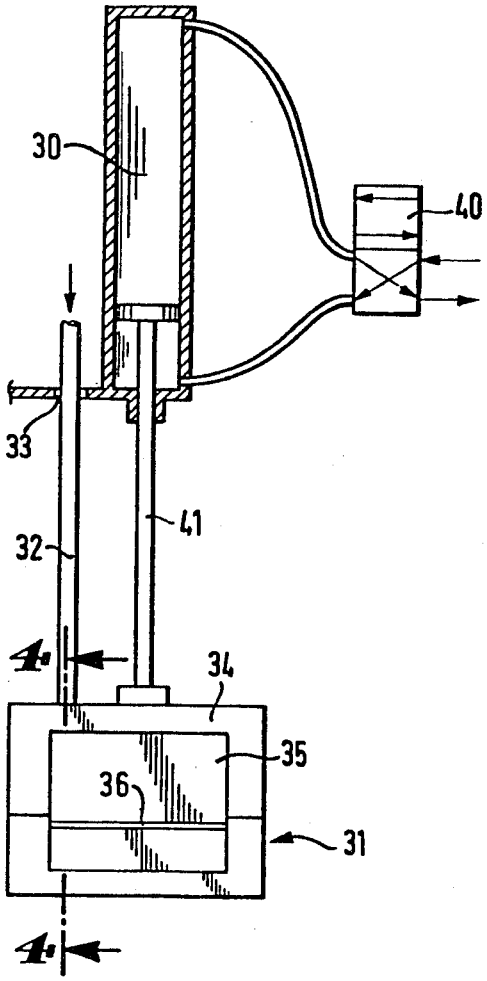
FIG. 3 is a diagrammatic front view of apparatus for deflecting the continuous length of yarn and introducing the deflected yarn into the cutting zone of the cutting machine.
Figure 4:
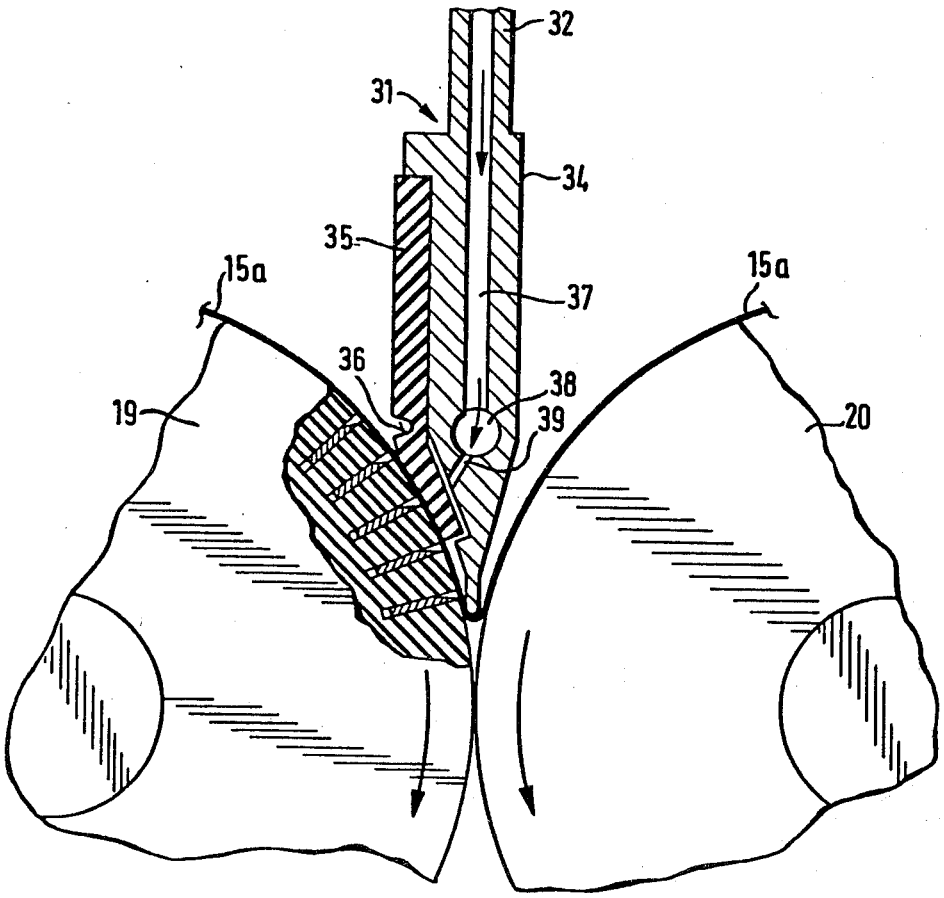
FIG. 4 is a partial sectional view as seen along the line 4—4 in FIG. 3, and further illustrating an operative relationship between the deflecting apparatus and rolls of the cutting machine which, for the sake of clarity, are not seen in FIG. 3.

The deflecting apparatus 22 is more particularly illustrated in FIGS. 3 and 4. As indicated, it is the function of the deflecting apparatus to deflect the yarn from the dash line path to the solid line path and ultimately into the cutting zone when the speed of movement of the yarn is at the operational speed and equalized to that of other yarns.

The deflecting apparatus 22 includes a cylinder 30, a piston and piston rod 41 controlled in linear movement, and a push rod 31 carried rigidly at the end of the piston rod. The piston may be either pneumatically or hydraulically controlled by operating fluid or liquid entering into the cylinder through ports located both to the top and bottom in accordance with the operation of distributor 40. Thus, in operation of the deflection apparatus the region of the cylinder above the piston is pressurized to move the push rod downwardly in the direction of force arrow F (FIG. 1A). In straight linear movement, from an upper limit position, push rod 31 encounters yarn 15*a*, progressively deflects it and at the end of operative limit of travel introduces it deeply between rolls 19, 20 (see FIG. 4). This action has the effect of locating yarn 15*a* in contact with a portion of the surface of roll 19, the blade-carrying roll, and roll 20 which functions as an anvil.

A rod 32 is also rigidly attached to push rod 31. Rod 32 is of extended length, disposed parallel to rod 41. The rod 32 serves to stabilize the push rod 31 in opposition to forces that may tend to cause it to rotate about the axis of rod 41 as the push rod is moved linearly during operation. To this end, an aperture 33 provided in the structure of cylinder 30 provides a collar or bushing for controlled vertical movement of rod 32.

Push rod 31 for the most part comprises a rigid body 34 which preferably is formed of metal. The body, as perhaps best seen in FIGS. 3 and 4, generally is rectangular in horizontal section throughout an upper region. Within the lower region, the obverse and reverse sides (reference being to FIG. 3) are inclined toward a bottom edge of the push rod 31 (perhaps best seen in FIG. 4). The angle of inclination of the sides toward the edge makes it possible to cause the yarn on deflection to penetrate deeply between the blade-carrying roll 19 and the anvil roll 20 at restart of the operation of segmenting the yarn. Actually, the edge of the push rod when the push rod is at the operative limit of travel may contact the surface of roll 19 driven clockwise by suitable drive means (not shown). The push rod 31 is particularly suitable when the upstream roll, that is the roll 19 in the form of invention of FIGS. 3 and 4, is the blade-carrying roll having blades whose edges only slightly project into the cutting zone. It is this upstream roll that acts in the drawing of yarn, more particularly set out below, and drives the roll 20 through the surface-to-surface contact of rolls within the cutting zone.

A conduit 37 and a chamber 38 are formed in body 34. The chamber may be cylindrical in outline and of a length to extend horizontally throughout a major length of the body. The conduit 37 communicates with chamber 38 and, additionally, communicates with a conduit formed by a hollow length of rod 32. As suggested by the arrow in FIG. 3, a pressurizing fluid such as air under pressure is communicated to hollowed-out interior of rod 32. Communication of compressed air is opened when the push rod 31 is at the operative limit of travel.

The front face of push rod 31 throughout a surface area within both the upper and lower regions is provided with a cut-out thereby to provide a housing for a plate 35. The plate 35 preferably is formed of a flexible material. The plate likewise includes an upper and lower region separated by a groove 36 extending the full width of the plate. At least the upper region of the plate fits tightly within the upper cutout and the lower region of the plate is received in the lower cutout. The upper region of the plate, further, is fastened within the upper cutout by an adhesive, for example. The lower region of the plate which locates to the inclined front face has freedom of movement for the purpose to be set out. The overall width of plate 35 is at least equal to the width of the active cutting zone defined by the length of the cutting blades (see FIG. 4). As may be seen in the Figure, the blades are regularly spaced about the periphery of roll 19 and there is a degree of contact under pressure with the surface of roll 20 within the cutting zone.

A slot or a plurality of individual conduits 39 communicate the chamber 38 and the cutout within the lower region of body 34. The length of the chamber is approximately equal to the width of plate 35. In this manner substantially the entire width of the plate will be acted upon by the compressed air as shall enter the cutout, behind the plate, from the several conduits or slot.

As previously stated, linear movement of the push rod 31 to the operative limit of travel effectively locates the yarn 15*a* in contact with a portion of the surface of the blade-carrying roll 19 and anvil roll 20 adjacent the cutting zone. At this point of the operation, as generally discussed, air under pressure is communicated to rod 32 and ultimately to the reverse side of the lower region of plate 35. The plate, under pressure, pivots about groove 16 and presses against the surface of the upstream roll, roll 19 in the form of the invention of FIG. 2, and yarn in contact with that surface. Under the joint effect of the driving adherence of the yarn on the surface of roll 19, the slight pinching effect on the yarn between the lower region of plate 35 and roll, and the compressed air escaping through the lower cutout in the body 34, and yarn is seized into the cutting zone. The push rod 31, under control of distributor 40, then is returned to the upper limit position. The length of yarn downstream of the yarn in the cutting zone is discharged through chute 28.

It is also contemplated that the upstream roll may comprise the roll 20 or anvil roll, while the downstream roll may comprise the roll 19, or blade-carrying roll. This particular form of the invention is illustrated in FIG. 5, and in the schematic showing in FIG. 1B.

In this form of the invention, it may be considered that the deflecting apparatus 50, to be described, operates in concert with operative components such as those both upstream and downstream of the deflecting apparatus 22 of the form of the invention illustrated in FIG. 2.

Figure 5:
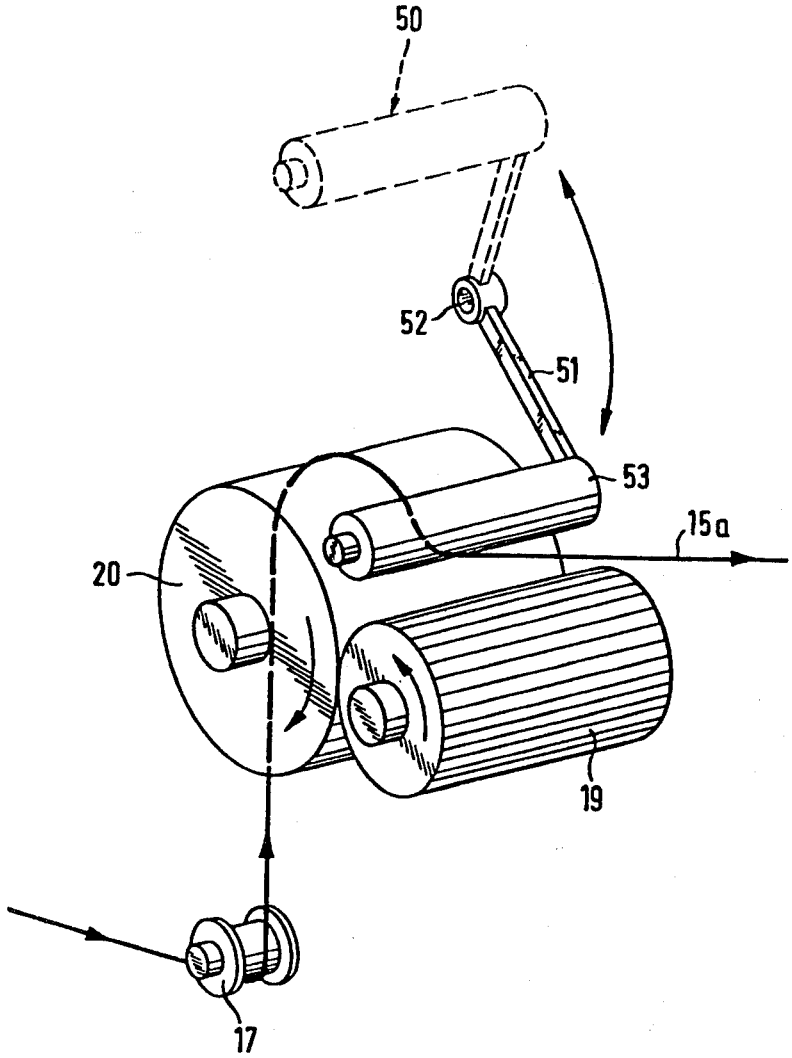
FIG. 5 is a diagrammatic view in perspective of a second form of cutting machine for implementing the process of FIG. 1B.

Deflecting apparatus 50 includes a roller 53 movable from a first or nonoperative limit position, the dash line position of FIG. 5, to a second operative limit portion, the full line position of that Figure. In the latter position, to which the roller is located when the speed of movement of the yarn is at the operational level and equalized with the speed of movement of other yarns, the roller 53 rests on the surface of the anvil roll 20, adjacent the cutting zone. The roller, thus, both presses on the yarn 15*a* and pinches it between the roller and surface, and in a manner somewhat similar to the operation of deflecting apparatus 22 causes the yarn to enter the cutting zone. For this purpose, the roller is of a length substantially equal to the length of roll 20.

Referring to FIG. 5, roller 53, carried on a shaft, is free to rotate relative to the shaft or with the shaft, as determined by the manner of mounting the shaft on arm 51. Arm 51, in turn, is supported by collar 52 and movement is imparted both to the arm and roller in the direction of the arrows to locate the roller as previously discussed. Movement may be provided by rotation of a shaft (not shown) to which collar 52 is keyed or otherwise connected or by means of any conventional means. Both the shafts mounting collar 52 and roller 53 are parallel to the axes of rolls 19, 20.

Figure 1B:
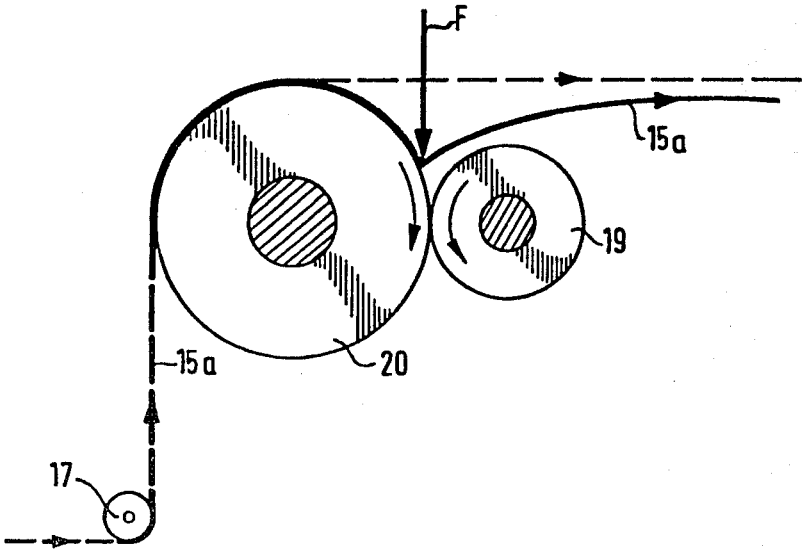

As illustrated in FIGS. 1B and 5, yarn 15*a* is trained about pulley 17 located below the horizontal plane including the axes of rolls 19, 20 so that the yarn drawn, for example, by drawing device 12 follows the dash line path. The yarn, thus, is in contact with roll 20 throughout about one-quarter of its outer surface and in the zone above roll 19. However, when roller 53 is located to the operative limit position, yarn 15*a* follows the full line path and then enters into the cutting zone. The yarn downstream of the cutting zone is evacuated by chute 28 and cut segments of yarn are conveyed away by transfer device 25.

The process according to the invention and the installations as described is adapted for cutting or segmenting yarn from either a plurality of spinnerets or from only one spinneret. In the latter situation, when the process of feeding yarn to the cutting apparatus is discontinued for any reason, it is possible to stop the cutting apparatus or, at least, to reduce the speed of rotation of rolls 19, 20. In this situation, also, the process may be restarted merely by manually drawing the yarn to the zone above the roll 19, although downstream of the roll, and then starting the rolls in slow rotation prior to activating the deflecting apparatus 22 (or 50) to deflect the yarn to a full line path of travel (see FIG. 1A or 1B).

The present invention provides several advantages over the prior art. Particularly, the invention permits a rapid restart of the cutting operation under conditions of full safety. Moreover, the deflecting apparatus of the invention may be used with substantially any cutting apparatus and, since it constitutes a structure separate and apart from the cutting apparatus it in no way impedes any necessary maintenance of the cutting apparatus. This feature is of particular advantage in assuring maximum productivity since shut-down of the entire process will not be unnecessarily extended by a necessity to disconnect the deflecting apparatus from the cutting apparatus.

What is claimed is:

1. A process of cutting at least one continuous yarn in a cutting machine formed by a blade-carrying roll and a support roll rotating in opposite directions about axes in substantially a horizontal plane comprising drawing said yarn from an upstream location downstream to said cutting machine along a first path of movement through a zone defined by opposite sides of said blade-carrying roll, deflecting said yarn from said first path to a second path of movement along which said yarn is supported in surface contact, adjacent a cutting zone between said rolls, as it lays flat on the roll of said cutting machine disposed upstream of the other roll, moving said yarn into said cutting zone, and collecting individual substantially equal length sections cut from said yarn.

2. The process of claim 1 wherein said first path of movement is above both said blade-carrying and support roll.

3. The process of claim 2 wherein said blade-carrying roll comprises the upstream roll.

4. The process of claim 1 or 2 wherein said yarn is drawn at a speed progressively increased from about 1 m/sec to an operative drawing speed, and, then, deflecting said yarn from said first path to said second path.

5. The process of claim 4 comprising drawing a plurality of yarns and deflecting each yarn either by simultaneously or individual deflection when each yarn to be deflected is being drawn at said operative speed and at a speed equalized with the speed of movement of each other yarn.

6. The process of claim 4 wherein each yarn is formed of glass filaments.

7. Apparatus for use in an installation wherein at least one continuous yarn is both drawn and supported along a first path of movement from an upstream location downstream to a cutting apparatus including a blade-carrying roll and a support roll rotating in opposite directions about axes in a substantially horizontal plane, said apparatus including a member for deflecting said yarn from said first path to a second path of movement along which said yarn is supported in contact with the surface of the upstream roll at least closely adjacent a cutting zone between said rolls, and means supporting said member for movement from a first inoperative position to a second operative position thereby to locate said yarn to said second path, and wherein said first path of movement extends above at least said blade-carrying roll and through a zone defined by opposite sides of said blade-carrying roll.

8. The apparatus of claim 7 wherein said member includes a body having an upper portion of generally rectangular outline along a plane perpendicular to said horizontal plane and a lower portion of an outline generally conforming to a space between rolls leading to the entry to said cutting zone, and wherein said support means moves said member linearly in a direction substantially perpendicular to said horizontal plane.

9. The apparatus of claim 8 wherein said upper and lower portions of said body extend parallel to said axes, said blade-carrying roll including a multiplicity of equidistantly spaced blades each providing a cutting edge along the surface of said blade-carrying roll, and said body having a length at least equal to the length of said cutting edges to confront the same when said member is in said operative position.

10. The apparatus of claim 8 including a plate of rectangular outline formed of a resilient material, and wherein said body extends perpendicular to said axes throughout a length substantially equal to the length of said blade-carrying roll, said plate being secured along its major dimension to said body within the upper region to extend into said lower region at an attitude generally parallel to the surface of said lower region, and means for moving said plate away from said lower surface toward said surface of said upstream roll when said member is in the operative position to pinch said yarn between said roll surface and plate to assist in moving said yarn into said cutting zone.

11. The device of claim 10 wherein said body is provided with a cutout which extends from said upper region into said lower region, said plate being fixedly supported in said cutout upper region and including a pivot axis along and within the vicinity of the demarcation of regions for movement controlled by said moving means.

12. The apparatus of claim 10 wherein said moving means includes a cylindrical chamber with said body, means for communicating a source of pressurized gas to said chamber, and at least one communicating path from said chamber to the surface of said lower region behind said plate.

13. The apparatus of claim 12 wherein said means supporting said member for movement includes a piston rod controlled by movement of a piston within a cylinder, and wherein said means communicating said source of pressurized gas to said chamber includes a hollow rod adapted for connection with said source and a conduit formed in said body, said support rod connected to said body conduit and supported in conjoint movement with said body.

14. The apparatus of claim 10 wherein said blade-carrying roll is located upstream of said support roll and includes a multiplicity of equidistantly spaced blades each providing a cutting edge along the surface of said blade-carrying roll.

15. The apparatus of claim 7 wherein said member includes a roller, said roller having a length substantially equal to the length of said blade-carrying roll, and wherein said means for supporting said roller for movement includes a shaft, an arm mounting said shaft at one end and mounted to a pivot at the other end, means imparting movement to said arm for moving said roller from a first inoperative position to a second operative position thereby to locate said yarn to said second path, and at least said roller mounted on said shaft having freedom of rotational movement.

16. The apparatus of claim 8 or 15 including a plurality of yarns each of which is deflected from said first to said second path of movement by said member.

17. The apparatus of claim 16 wherein said yarn is formed of glass filaments.

18. An installation including means for forming at least one continuous yarn from a multiplicity of filaments, means for drawing said yarn and means for supporting said yarn for movement from said forming means downstream along a first path of movement, a cutting apparatus including a blade-carrying roll and a support roll rotating in opposite directions about axes in a horizontal plane, said apparatus including a member for deflecting said yarn from said first path to a second path of movement along which said yarn is supported in contact with the surface of the upstream roll at least closely adjacent a cutting zone between said rolls, and means supporting said member for movement from a first inoperative position to a second operative position thereby to locate said yarn to said second path, and wherein said first path of movement extends above at least said blade-carrying roll and through a zone defined by opposite sides of said blade-carrying roll.

19. The installation of claim 18 wherein said means for drawing said yarn is located downstream of said cutting apparatus and wherein said drawing means together with pulley means located upstream of said cutting apparatus support said yarn for movement.

20. The installation of claim 19 including a plurality of forming means, and wherein said yarns include filaments of glass.

* * * * *

UNITED STATES PATENT AND TRADEMARK OFFICE

CERTIFICATE OF CORRECTION

PATENT NO. : 4,411,180

DATED : October 25, 1983

INVENTOR(S) : Giordano Roncato

It is certified that error appears in the above-identified patent and that said Letters Patent are hereby corrected as shown below:

Column 4, line 63, "until" should be --unit--.

Column 6, line 48, "16" syould be --36--.

Column 6, line 55, "and" should be --the--.

Column 8, line 56, "parallel" should be --perpendicular--.

Signed and Sealed this

Seventh Day of February 1984

[SEAL]

*Attest:*

GERALD J. MOSSINGHOFF

*Attesting Officer*

*Commissioner of Patents and Trademarks*